US011679312B2

(12) United States Patent
You

(10) Patent No.: US 11,679,312 B2
(45) Date of Patent: Jun. 20, 2023

(54) COMBINATION PUTTER AND CHIPPER GOLF CLUB

(71) Applicant: DRG KOREA CO., LTD, Gyeonggi-do (KR)

(72) Inventor: Byung Yong You, Gyeonggi-do (KR)

(73) Assignee: DRG KOREA CO., LTD, Gyeonggi-do (KR)

( * ) Notice: Subject to any disclaimer, the term of this patent is extended or adjusted under 35 U.S.C. 154(b) by 5 days.

(21) Appl. No.: 17/423,672

(22) PCT Filed: Dec. 17, 2020

(86) PCT No.: PCT/KR2020/018591
§ 371 (c)(1),
(2) Date: Jul. 16, 2021

(87) PCT Pub. No.: WO2021/132987
PCT Pub. Date: Jul. 1, 2021

(65) Prior Publication Data

US 2022/0088445 A1 Mar. 24, 2022

(30) Foreign Application Priority Data

Dec. 23, 2019 (KR) ..... 10-2019-0173168

(51) Int. Cl.
*A63B 53/04* (2015.01)
*A63B 53/06* (2015.01)

(52) U.S. Cl.
CPC ..... *A63B 53/0416* (2020.08); *A63B 53/047* (2013.01); *A63B 53/0408* (2020.08);
(Continued)

(58) Field of Classification Search
CPC . A63B 53/04; A63B 53/0416; A63B 53/0487; A63B 53/065; A63B 53/08
(Continued)

(56) References Cited

U.S. PATENT DOCUMENTS 1,135,621 A * 4/1915 Roberts et al. ..... A63B 60/00 473/245
2,201,638 A * 5/1940 Theibault, Sr. ..... A63B 53/06 403/379.2

(Continued)

FOREIGN PATENT DOCUMENTS

CN 2506309 Y 8/2002
CN 107088295 A 8/2017

(Continued)

OTHER PUBLICATIONS

Office Action issued by the Chinese Patent Office dated Jan. 11, 2022.

(Continued)

*Primary Examiner* — Alvin A Hunter
(74) *Attorney, Agent, or Firm* — IP &T Group LLP

(57) ABSTRACT

A putter-chipper golf club may include: a body 110 including a coupling groove portion 110*a* having a through-hole formed therein; a variable face 120 disposed on one side of the body 110 and configured to function as a putter face or a chipper face; a spring 130 disposed on the circumference of a part of the coupling protrusion portion 120*a*; and a face cap 150 disposed adjacent to the spring 130. When the coupling groove portion 110*a* of the body 110 and the coupling protrusion portion 120*a* of the variable face 120 are disengaged from each other by pulling the variable face 120 from the body 110 toward one side, the golf club may be switched to a putter or a chipper through rotation of the variable face 120.

13 Claims, 45 Drawing Sheets

(52) U.S. Cl.
CPC ..... *A63B 53/0458* (2020.08); *A63B 53/065* (2013.01); *A63B 2053/0483* (2013.01); *A63B 2053/0495* (2013.01)

(58) Field of Classification Search
USPC ..... 473/324–350
See application file for complete search history.

(56) References Cited

U.S. PATENT DOCUMENTS

| | | | | | |
|---|---|---|---|---|---|
| 3,419,275 | A * | 12/1968 | Winkleman | A63B 53/0487 | 473/335 |
| 4,618,149 | A * | 10/1986 | Maxel | A63B 53/0466 | 473/245 |
| 5,230,509 | A | 7/1993 | Chavez | | |
| 5,407,196 | A * | 4/1995 | Busnardo | A63B 60/00 | 473/307 |
| 5,531,445 | A * | 7/1996 | Levocz | A63B 53/02 | 473/328 |
| 5,542,665 | A * | 8/1996 | Levocz | A63B 60/00 | 473/313 |
| 5,569,098 | A * | 10/1996 | Klein | A63B 53/007 | 473/316 |
| 5,863,257 | A * | 1/1999 | Busnardo | A63B 53/065 | 473/307 |
| 6,270,423 | B1 * | 8/2001 | Webb | A63B 53/065 | 473/226 |
| 6,464,598 | B1 * | 10/2002 | Miller | A63B 60/00 | 473/340 |
| 6,979,269 | B1 * | 12/2005 | Nohara | A63B 60/00 | 473/251 |
| 7,837,576 | B1 * | 11/2010 | Paige | A63B 69/3676 | 473/340 |
| 2003/0060301 | A1 * | 3/2003 | Hsu | A63B 53/0487 | 473/239 |
| 2007/0021236 | A1 * | 1/2007 | Tucker | A63B 53/06 | 473/340 |
| 2007/0111813 | A1 * | 5/2007 | Edel | A63B 55/00 | 473/307 |
| 2007/0184915 | A1 * | 8/2007 | Mansfield | A63B 53/0487 | 473/340 |
| 2008/0132349 | A1 * | 6/2008 | Hinojosa | A63B 53/0487 | 473/340 |
| 2008/0153619 | A1 * | 6/2008 | Tucker | A63B 53/065 | 473/409 |
| 2010/0331104 | A1 * | 12/2010 | Renna | A63B 53/0487 | 473/340 |
| 2016/0220875 | A1 * | 8/2016 | Sanyal | A63B 53/065 | |
| 2018/0104554 | A1 | 4/2018 | Sanyal et al. | | |
| 2019/0022482 | A1 * | 1/2019 | Sanyal | A63B 53/0487 | |

FOREIGN PATENT DOCUMENTS

| | | | | |
|---|---|---|---|---|
| CN | 107803000 | A | 3/2018 | |
| CN | 109661256 | A | 4/2019 | |
| FR | 2554003 | A1 * | 5/1985 | |
| GB | 191403365 | A * | 11/1914 | |
| GB | 2281040 | A * | 2/1995 | A63B 53/04 |
| JP | 2012-000129 | A | 1/2012 | |
| KR | 200158533 | Y1 * | 10/1999 | |
| KR | 10-0955871 | B1 | 5/2010 | |
| KR | 10-1178387 | B1 | 9/2012 | |
| KR | 10-1691922 | B1 | 1/2017 | |
| WO | WO-9700100 | A1 * | 1/1997 | A63B 53/02 |
| WO | WO-0151135 | A1 * | 7/2001 | A63B 53/0487 |
| WO | WO-2021132987 | A2 * | 7/2021 | A63B 53/007 |

OTHER PUBLICATIONS

International Search Report issued by the Korean Intellectual Property Office dated Jul. 22, 2021.

* cited by examiner (a)

(b)

COMBINATION PUTTER AND CHIPPER GOLF CLUB

This application is a national stage application of PCT/KR2020/018591 filed on Dec. 17, 2020, which claims priority of Korean patent application number 10-2019-0173168 filed on Dec. 23, 2019. The disclosure of each of the foregoing applications is incorporated herein by reference in its entirety.

TECHNICAL FIELD

The present disclosure relates to a golf club, and more particularly, to a putter-chipper golf club which enables a user to select and use a putter or chipper according to the purpose of use.

BACKGROUND ART

Recently, golf has been popularized as the awareness of golf is changed with the improvement in living standards all over the world.

Golf clubs as well as golf balls are main components of golf equipment, and divided into a driver, spoons, irons, a putter and the like depending on the purpose of use.

While playing golf with golf clubs, a golfer uses a putter or chipper according to the purpose of use. In general, when missing a hole after making an iron shot on the field or making a driver shot at a tee box, a golfer finally uses a putter to get a ball into a hole cup from a location close to the hole cup, and uses a chipper to make an approach shot for getting a ball near the hole cup on the green.

As such, the putter and the chipper are designed for different purposes of use, and the shapes thereof are also clearly distinguished from each other according to the purpose of use. Thus, it is troublesome and inconvenient for a golfer to carry both a putter and a chipper in a golf bag, for a smooth golf game.

In order to solve the problem, Korean Patent No. 10-1178387 provides a golf putter 1 with multi-function as illustrated in FIGS. 1A and 1B. The golf putter 1 with multi-function includes a putter head 10, a face block 20 and a magnet 40. The putter head 10 has a shaft 30 connected thereto, the face block 20 has front and rear surfaces formed as a putter surface 21 and a chipper surface 22, respectively, and the magnet 40 couples the putter head 10 and the face block 20 to each other. The golf putter 1 with multi-function functions as a putter 1*a* when the front surface of the face block 20 is the putter surface 21, and functions as a chipper 1*b* when the front surface of the face block 20 is the chipper surface 22. However, such a golf putter 1 with multi-function has a structure in which the putter head 10 and the face block 20 are not integrated with each other but completely separated from each other. Thus, it is difficult to maintain the face block 20, and the face block 20 may be lost.

Furthermore, the magnetic force of the magnet 40 may gradually weaken with the elapse of time, and the coupling force between the putter head 10 and the face block 20 may be reduced by an impact applied to the putter head during a swing.

DISCLOSURE

Technical Problem

Various embodiments are directed to a combination putter and chipper golf club (hereinafter referred to as a "putter-chipper golf club") which enables a user to select a putter or a chipper according to the purpose of use. Also, various embodiments are directed to a golf club including a variable face having one surface, of which a part is formed as a putter surface and the other part is formed as a chipper surface, and thus improves forward straightness and rotational force of a golf ball. However, such embodiments are only examples, and do not limit the scope of the present disclosure.

Technical Solution

In an embodiment, a putter-chipper golf club may include: a body having a shaft connected thereto, and including a coupling groove portion having a through-hole formed therein; a variable face disposed on one side of the body, including a coupling protrusion portion which is inserted into the through-hole and engaged with the coupling groove portion, and configured to function as a putter face or a chipper face; a spring stored in the through-hole of the coupling groove portion, and disposed on the circumference of a part of the coupling protrusion portion; and a face cap disposed adjacent to the spring, and coupled to an end of the coupling protrusion portion of the variable face, wherein when the coupling groove portion of the body and the coupling protrusion portion of the variable face are disengaged from each other by pulling the variable face from the body toward one side, the golf club is switched to a putter or a chipper through rotation of the variable face.

In the putter-chipper golf club of the embodiment, a part of the front surface of the variable face may be formed as a putter surface, and the other part of the front surface of the variable face may be formed as a chipper surface.

In the putter-chipper golf club of the embodiment, the through-hole of the body may be constituted by a small-diameter portion and a large-diameter portion, and the coupling protrusion portion of the variable face may be inserted into the small-diameter portion of the through-hole of the body. The spring may be stored in the large-diameter portion of the through-hole of the body.

In the putter-chipper golf club of the embodiment, the golf club may function as a putter when the putter surface is located at the top, and function as a chipper when the chipper surface is located at the top.

In the putter-chipper golf club of the embodiment, the putter surface may be formed as a planar surface or a curved surface.

In the putter-chipper golf club of the embodiment, when the putter surface is a planar surface, the putter surface may have a loft θ of 1° to 3° with respect to a vertical line.

In the putter-chipper golf club of the embodiment, when the golf club functions as a putter and the putter surface is a planar surface, the height of the point where the putter surface starts may be set in the range of about 17 mm to 23 mm.

In the putter-chipper golf club of the embodiment, when the golf club functions as a putter and the putter surface is a curved surface, the height of the most protruding portion of the putter surface toward the front may be set to a value equal to or higher than the height of the center of a golf ball.

In the putter-chipper golf club of the embodiment, when the golf club functions as a chipper, the angle between the chipper surface and the ground may range from about 35° to 65°.

In the putter-chipper golf club of the embodiment, the inside contour of the coupling groove portion of the body and the outside contour of the coupling protrusion portion of the variable face may correspond to each other. When the variable face is axially moved toward the body, the inside contour of the coupling groove portion of the body and the outside contour of the coupling protrusion portion of the variable face may be fitted and engaged with each other.

In the putter-chipper golf club of the embodiment, the putter-chipper golf club may include a side weight and/or a low weight mounted on the body, in order to adjust the center of gravity.

In the putter-chipper golf club of the embodiment, when the side weight is mounted on the body, a rail protrusion may be formed on either outer surface of the body, a rail groove may be formed in a coupling inner surface of the side weight, and the rail protrusion of the body and the rail groove of the side weight may be enabled and coupled with each other.

In another embodiment, a putter-chipper golf club may include: a body having a shaft connected thereto; and a variable face coupled to one side of the body. The variable face may have one surface constituted by a putter surface corresponding to a height and a chipper surface corresponding to a different height, the variable face and the body may be coupled to each other by fitting or sliding, and the position where the variable face is mounted on the body may be changed so that the golf club functions as a putter or a chipper.

In the putter-chipper golf club of the another embodiment, when the variable face and the body are coupled to each other by sliding, a rail protrusion may be formed on a coupling surface of the variable face or a coupling surface of the body, a rail groove corresponding to the contour of the rail protrusion may be formed on the coupling surface of the variable face or the coupling surface of the body, and the rail protrusion and the rail groove may be engaged and coupled with each other by sliding.

In still another embodiment, there is provided a putter head for a golf putter, to which a shaft S having a grip hold by a user's hand is coupled. Only a front top region of the putter head may function as a putter surface, and a front bottom region of the putter head may be formed as a space which is not contacted with a golf ball.

In the putter-chipper golf club of the still another embodiment, the height of the start point of the putter surface at the front of the putter head may be set in the range of about 17 mm to about 23 mm.

In yet another embodiment, there is provided a golf putter including the above-described putter head.

In the putter-chipper golf club of still yet another embodiment, the body and the variable face may be coupled to each other through a magnet or rotation.

Advantageous Effects

In accordance with the embodiments of the present disclosure, the golf club may function as a putter or a chipper according to the purpose of use. Also, the golf club may include the variable face having one surface, of which a part is formed as the putter surface and the other part is formed as the chipper surface, and thus improve forward straightness and rotational force of a golf ball.

MODE FOR INVENTION

Figure 1A:
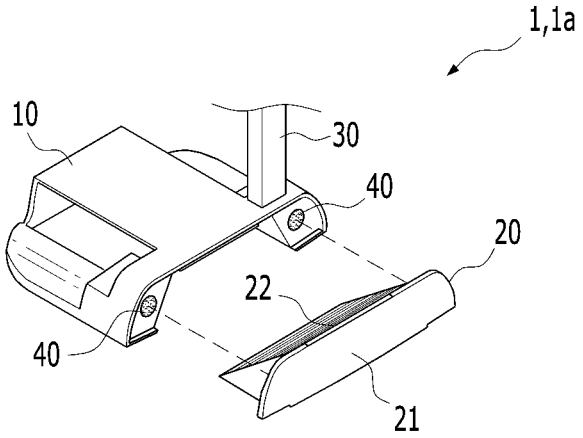
FIGS. 1A and 1B are schematic perspective views of a golf putter according to the related art.
Figure 1B:
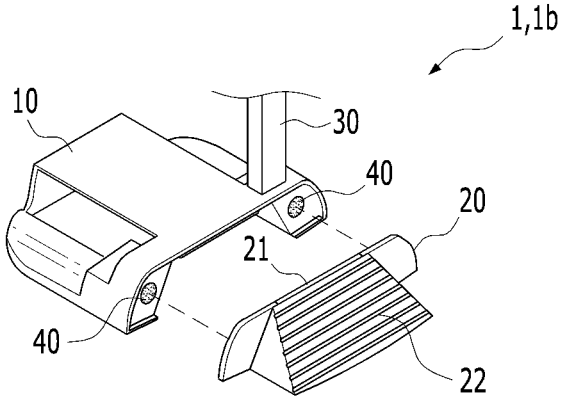

The above-described purposes, features and advantages of the present disclosure will be more clarified through the following embodiments with reference to the accompanying drawings.

The following descriptions of specific structures or functions are made only to describe embodiments according to the concept of the present disclosure. The embodiments according to concept of the present disclosure may be carried out in various manners, and should not be interpreted as being limited to the embodiments described in the present specification or application.

Since the embodiments according to the concept of the present disclosure can be modified in various manners and have various forms, specific embodiments will be illustrated in the drawings and described in detail in the present specification or application. However, it should be understood that the embodiments according to the concept of the present disclosure are not limited to specific embodiments, and but include all modification, equivalents or substitutes which are included in the technical idea and scope of the present disclosure.

The terms such as first and/or second may be used for describing various components, but the components should not be limited to the terms. The terms are only used to distinguish one component from other components. For example, a first component may be referred to as a second component, and the second component may be referred to as the first component, without departing from the scope according to the concept of the present disclosure.

When a component is referred to as being "coupled" or "connected" to another component, it should be understood that the former component may be directly coupled or connected to the latter component, or another component may be present between the former and latter components. On the other hand, when a component is referred to as being "directly coupled" or "directly connected" to another component, it should be understood that no component is present therebetween. Other expressions for describing the relation between components, such as "between", "immediately between", "adjacent to", and "directly adjacent to" should be interpreted in the same manner.

The terms used in the present specification are used only to describe a specific embodiment, and do not limit the present disclosure. An expression of a singular form includes an expression of a plural form unless referred to the contrary. In the present specification, the term of "include" or "have" specifies the existence of a property, a number, a step, a process, an element, a component, or combinations thereof, but does not exclude the existence or addition possibility of one or more other properties, numbers, steps, processes, elements, components, or combinations thereof.

All terms used herein may have the same meanings as those generally understood by those skilled in the art to which the present disclosure pertains, unless differently defined. The terms defined in a dictionary generally used should be interpreted as the meanings coinciding with those in the context of the related art, and should not be interpreted as ideal or excessively formal meanings, unless clearly defined in the present specification.

Hereafter, embodiments of the present disclosure will be described in detail with reference to the accompanying drawings. Like reference numerals in the drawings represent the same members.

Figure 2:
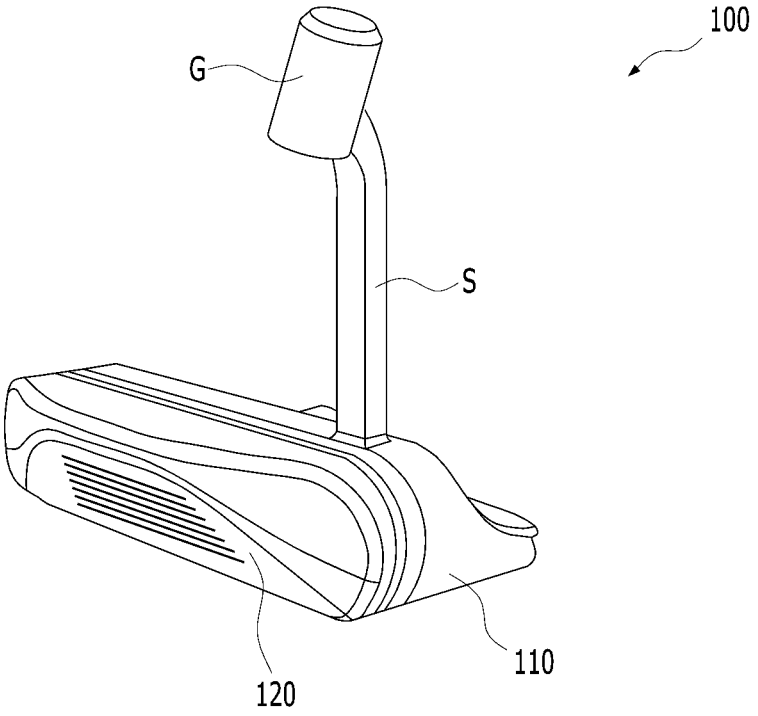
FIG. 2 is a schematic perspective view of a golf club in accordance with an embodiment of the present disclosure.
Figure 3A:
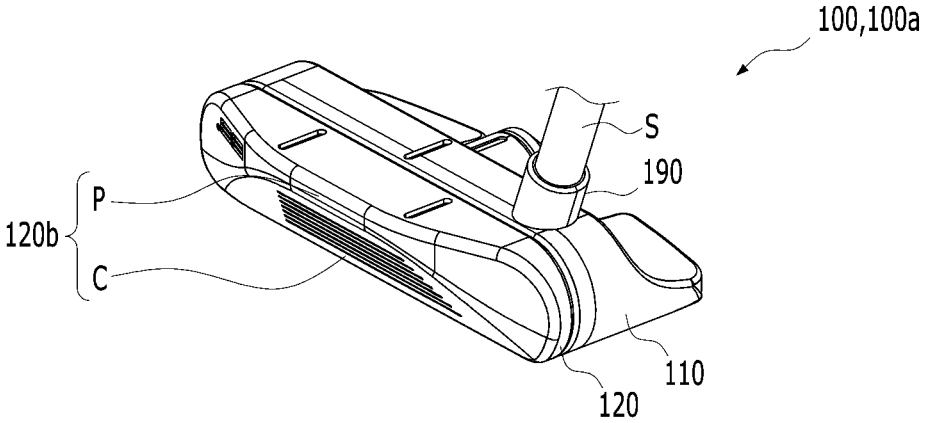
FIGS. 3A and 3B are expanded views of the golf club in accordance with the embodiment of the present disclosure.
Figure 3B:
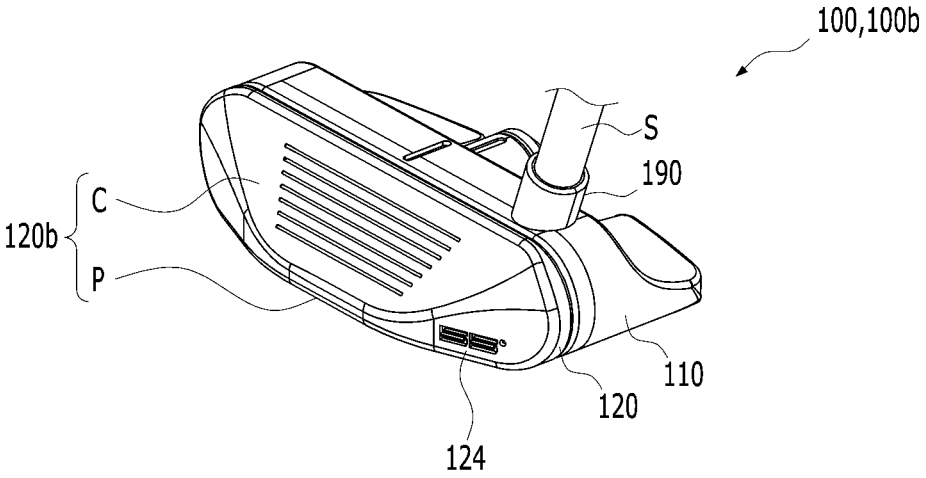
Figure 4:
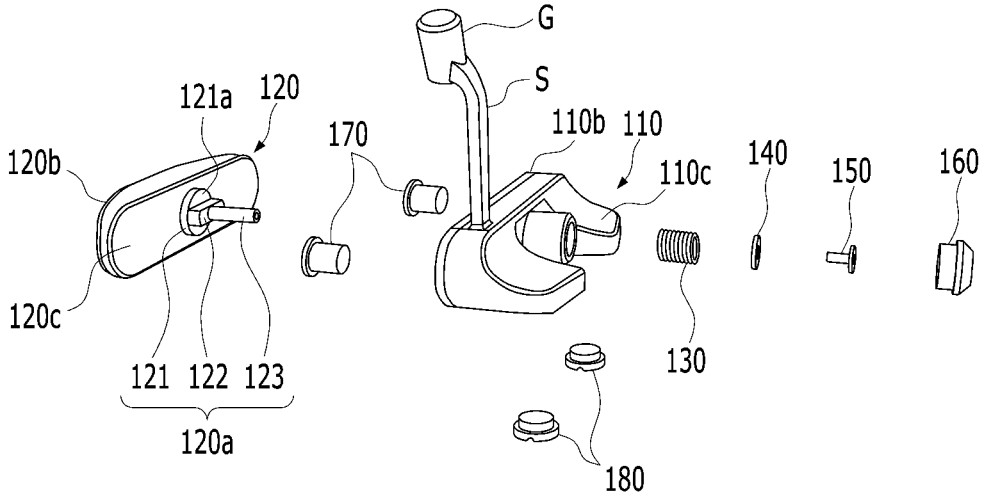
FIG. 4 is an exploded perspective view of the golf club in accordance with the embodiment of the present disclosure.
Figure 5A:
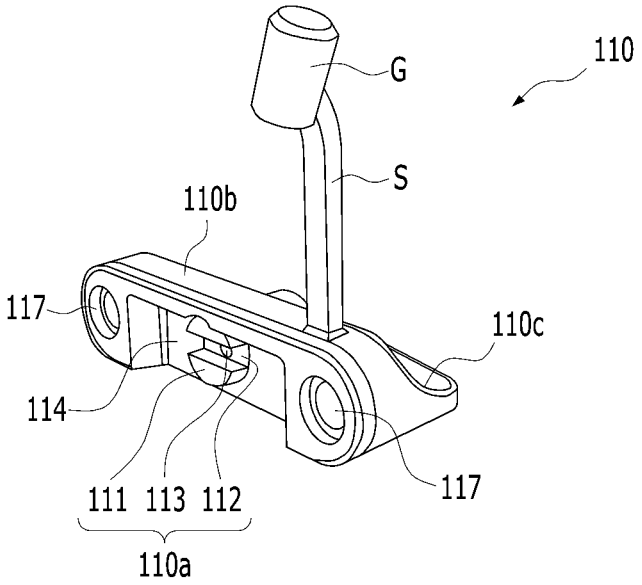
FIGS. 5A and 5B are perspective views illustrating a body of the golf club in accordance with the embodiment of the present disclosure.
Figure 5B:
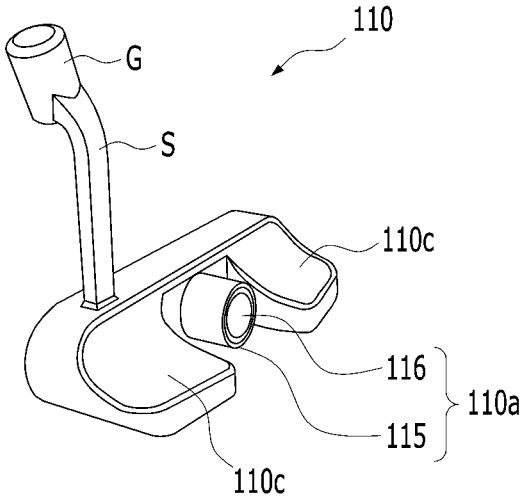
Figure 6A:
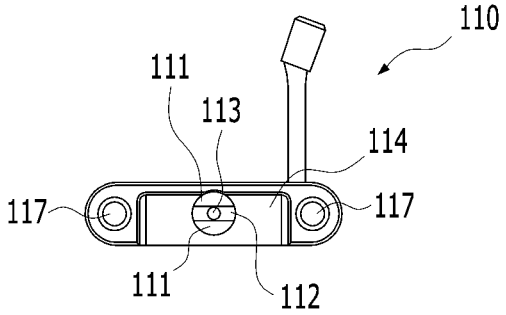
FIGS. 6A to 6E are schematic views illustrating the body of the golf club in accordance with the embodiment of the present disclosure.
Figure 6B:
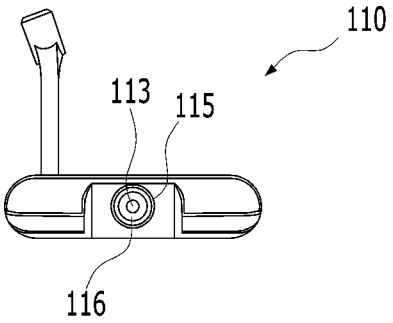
Figure 6C:
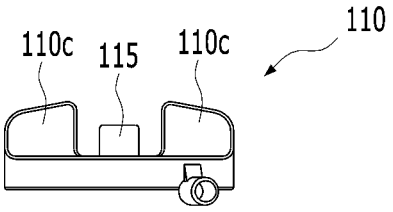
Figure 6D:
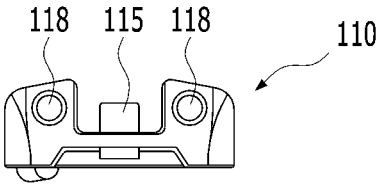
Figure 6E:
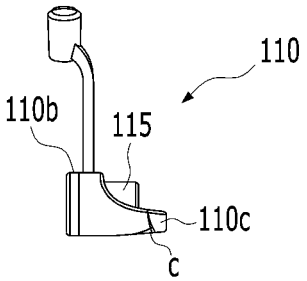

FIG. 2 is a perspective view of a putter-chipper golf club in accordance with an embodiment of the present disclosure; FIG. 3A is a diagram illustrating the golf club which functions as a putter 100*a*; FIG. 3B is a diagram illustrating the golf club which functions as a chipper 100*b*; FIG. 4 is an exploded perspective view of the putter-chipper golf club in accordance with the embodiment of the present disclosure; FIG. 5A is a diagram illustrating a front surface of a body of the putter-chipper golf club;

FIG. 5B is a diagram illustrating a rear surface of the body of the putter-chipper golf club; FIG. 6A is a schematic front view of the body; FIG. 6B is a schematic rear view of the body; FIG. 6C is a schematic plan view of the body; FIG. 6D is a schematic bottom view of the body; and FIG. 6E is a schematic side view of the body.

The putter-chipper golf club 100, 100*a* and 100*b* in accordance with the embodiment of the present disclosure may include a body 110, a variable face 120, a spring 130 and a face cap 150. In accordance with the present disclosure, as a user manipulates the variable face 120 according to the purpose of use, the golf club 100 may function as a putter 100*a* or a chipper 100*b*. As illustrated in FIGS. 3A and 3B, one golf club 100 may be switched to the putter 100*a* or the chipper 100*b* according to a user's selection, which makes it possible to remove inconvenience in case that the user needs to separately carry a putter and a chipper.

As illustrated in FIG. 2, the golf club 100 in accordance with the embodiment of the present disclosure may have a shaft S which is fitted into a grip G, has a predetermined length, and is connected to the body 110. The shaft S may be integrated with the body 110, or formed as a separate component from the body 110 and coupled to the body 110. Furthermore, when the body 110 and the shaft S are separate components, the body 110 may include a fixing portion 190 to fix the shaft S, for example. The grip G and the shaft S may have various shapes and structures.

As illustrated in FIGS. 5A and 5B and 6A to 6E, the body 110 of the putter-chipper golf club 100 in accordance with the embodiment of the present disclosure may be constituted by a main body portion 110*b* and a tail portion 110*c* extended from the main body portion 110*b*. The tail portion 110*c* may include a curved shape c to minimize friction with the ground during a swing. However, this is only an example, but the shape of the tail portion 110*c* is not limited thereto. Furthermore, the body 110 may have a concave portion 114 formed in a part of the front surface thereof so as to be coupled to the variable face 120. Due to the concave portion 114, the variable face 120 and the body 110 may have portions which are contacted with each other and portions which are not contacted with each other. As illustrated in FIGS. 7A to 7C and 8A and 8B, a space A may be formed between the portions of the variable face 120 and the body 110, which are not contacted with each other. Through the space A, a user may hold the bottom of the variable face 120, and try to couple or decouple the variable face 120 and the body 110 to or from each other.

The concave portion 114 may have a coupling groove portion 110*a* formed therein. The coupling groove portion 110*a* may include a first corresponding portion 111, a second corresponding portion 112, a through-hole formed through the body 110, and a protrusion portion 115. The through-hole may be constituted by a small-diameter portion 113 and a large-diameter portion 116. The variable face 120 may be coupled to one side of the body 110 by the coupling groove portion 110*a*. The body 110 may selectively include grooves 117 and 118 in which a side weight 170 and a low weight 180 are mounted.

Figure 14A:
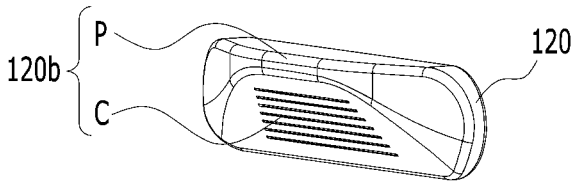
FIGS. 14A to 14C are schematic views illustrating a variable face in accordance with the embodiments of the present disclosure.

In the putter-chipper golf club 100 in accordance with the embodiment of the present disclosure, the variable face 120 may be disposed on one side of the body 110. As illustrated in FIG. 14A, a front surface 120*b* of the variable face 120 may be formed as a putter surface P and a chipper surface C. Specifically, a part of the front surface 120*b*, corresponding to a height h1, may be formed as the putter surface P, and a part of the front surface 120*b*, corresponding to a height h2 different from the height h1, may be formed as the chipper surface C. The putter surface P may be formed as a planar surface or curved surface. When the putter surface P is formed as a planar surface, the putter surface P may have a loft θ of about 1° to 3° with respect to a vertical line. Furthermore, the angle between the chipper surface C and the ground may range from about 35° to 65°. However, the present disclosure is not limited thereto.

Since the putter surface P and the chipper surface C are simultaneously formed on one surface, a user may easily select the function of the putter 100*a* or the chipper 100*b* by switching the positions of the putter surface P and the chipper surface C. That is, by changing the position of the variable face 120 mounted on the body 110, the golf club 100 in accordance with the embodiment of the present disclosure may function as the putter 100*a* or the chipper 100*b*. In accordance with the embodiment of the present disclosure, the golf club may function as the putter 100*a* when the putter surface P is located at the top, and function as the chipper 100*b* when the chipper surface C is located at the top.

Figure 14B:
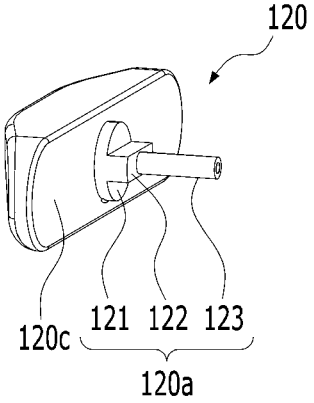
Figure 14C:
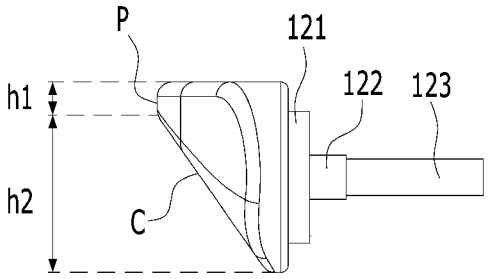

As illustrated in FIG. 14B, a rear surface 120*c* of the variable face 120 may have a coupling protrusion portion 120*a*. The coupling protrusion portion 120*a* may be inserted into the small-diameter portion 113 of the through-hole of the body 110 and engaged with the coupling groove portion 110*a* of the body 110. For example, the coupling protrusion portion 120*a* may include a first portion 121, a second portion 122 and a coupling shaft 123.

The variable face 120 may include an angle display part 124 installed on the front surface 120*b*. Such an angle display part 124 may display the angle of the chipper (i.e. the angle between the ground and the chipper surface C), for example. Thus, the user may easily identify the chipper angle of the golf club, and select a suitable variable face according to the user's preference.

The body 110 and the variable face 120 may be made of a metallic material. However, the present disclosure is not limited thereto, but the body 110 and the variable face 120 may be made of various materials.

As illustrated in FIGS. 7A to 7C and 8A and 8B, the spring 130 may be stored in the large-diameter portion 116 of the through-hole of the coupling groove portion 110*a*. The spring 130 may be disposed on the outer circumferential surface of a part of the coupling protrusion portion 120*a*. For example, the spring 130 may have a shape to surround at least a part of the coupling shaft 123 of the coupling protrusion portion 120*a*. Such a spring 130 is preferably a compressive coil spring. However, the present disclosure is not limited thereto, but the spring 130 may be a tensile coil spring.

As illustrated in FIGS. 7A to 7C and 8A and 8B, the face cap 150 may be stored in the large-diameter portion 116 of the through-hole of the coupling groove portion 110*a*, and disposed adjacent to the spring 130. Furthermore, the face cap 150 may be coupled to an end of the coupling shaft 123 of the coupling protrusion portion 120*a* of the variable face 120, which is inserted through the through-holes formed in the body 110. In this case, a protrusion formed on the face cap 150 may be forced into an insertion groove formed at the end of the coupling shaft 123.

The golf club 100 in accordance with the present disclosure may further include a body cap 160 coupled to the body 110. For example, the body cap 160 may be fitted into an end of the protrusion portion 115 of the body 110. Basically, the golf club 100 in accordance with the embodiment of the present disclosure has not a completely detachable structure but an integrated structure that enables a user to select the putter or the chipper. However, the body cap 160 and the face cap 150 may be pulled out to detach/attach the variable face 120. Therefore, the user may select the variable face 120 having a suitable chipper angle, face size or the like according to the user's preference.

Figure 7A:
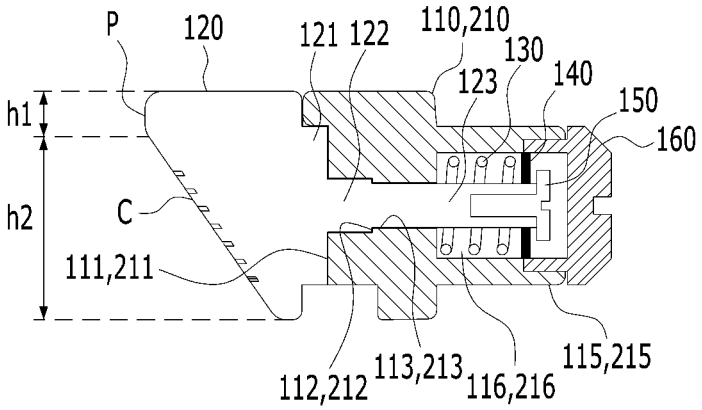
FIGS. 7A to 7C are schematic views illustrating a coupling process of the golf club in accordance with the embodiment of the present disclosure.
Figure 7B:
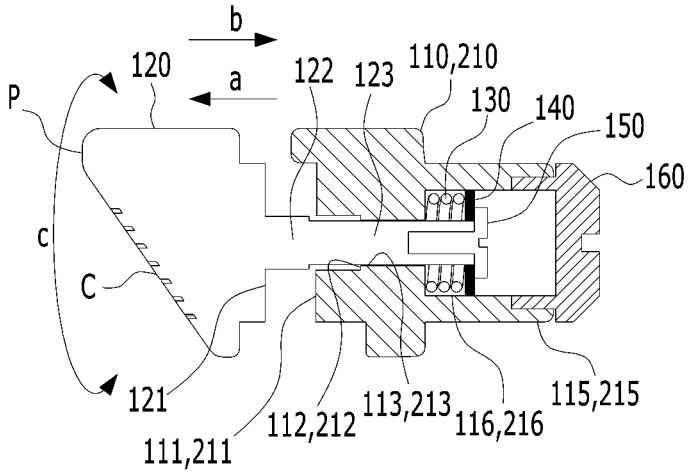
Figure 7C:
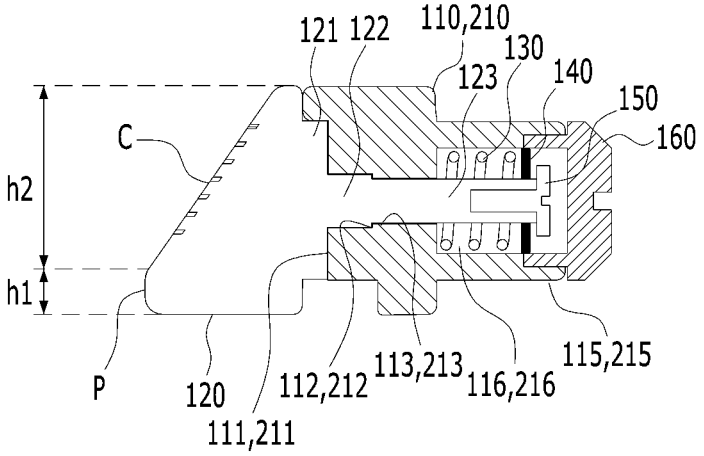

In the putter-chipper golf club 100 in accordance with the embodiment of the present disclosure, the inside contour of the coupling groove portion 110*a* of the body 110 and the outside contour of the coupling protrusion portion 120*a* of the variable face 120 may correspond to each other. Thus, when the variable face 120 is moved axially toward the body 110, the inside contour of the coupling groove portion 110*a* of the body 110 and the outside contour of the coupling protrusion portion 120*a* of the variable face 120 may be coupled to each other while fitted and engaged with each other. For example, as illustrated in FIGS. 7A to 7C, the second portion 122 of the coupling protrusion portion 120*a* may be inserted into the second corresponding portion 112 of the coupling groove portion 110*a*, and the coupling shaft 123 of the coupling protrusion portion 120*a* may be partially fitted into the small-diameter portion 113 and partially disposed in the large-diameter portion 116, while inserted into the small-diameter portion 113 of the coupling groove portion 110*a*. The spring 130 may be disposed on the outer circumferential surface of a part of the coupling shaft 123 disposed in the large-diameter portion 116, and the face cap 150 may be coupled to the end of the coupling shaft 123.

Figure 15A:
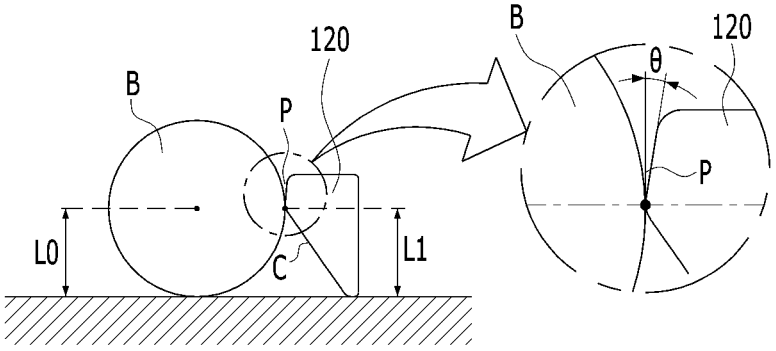
FIGS. 15A to 15D are schematic views illustrating the relationship between a golf ball and the golf club in accordance with the embodiments of the present disclosure.
Figure 15B:
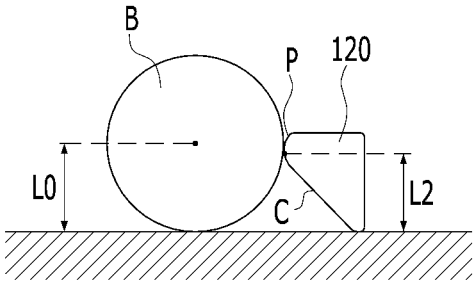
Figure 15C:
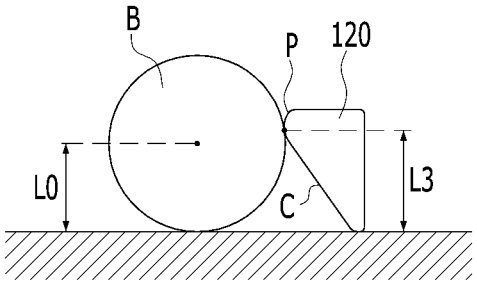
Figure 15D:
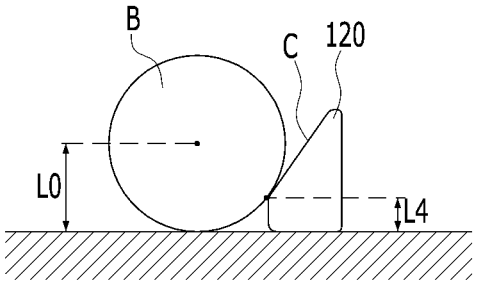
Figure 16:
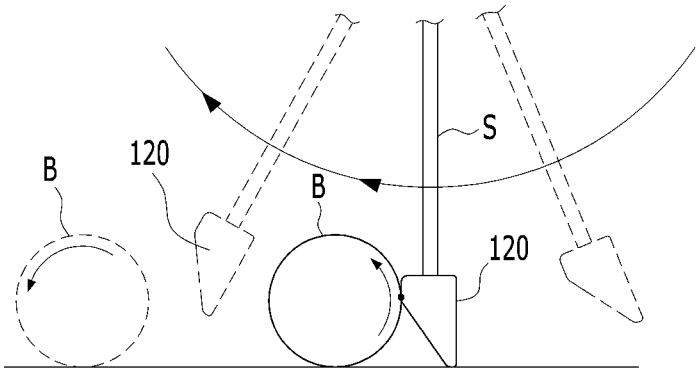
FIG. 16 is a schematic view illustrating an operation of the golf club in accordance with the embodiments of the present disclosure.

FIGS. 15A to 15D illustrate the correlation between a golf ball B and the variable face 120, and FIG. 16 schematically illustrates a putting stroke.

When the golf ball B is compared to the size of a typical golf putter head, the diameter of the golf ball B is about 42.67 mm, and the height (about 21.33 mm) of the face surface of the putter head is smaller than the height of the golf ball B. Furthermore, when a user hits the golf ball B with the putter during putting, the face surface of the putter hits the central portion of the golf ball B, and the putter head is moved upward after passing through the point where the putter hits the golf ball B.

In consideration of such aspects, when the putter surface P of the variable face 120 of the golf club 100 and 100*a* functioning as the putter in accordance with the embodiment of the present disclosure is a planar surface, a height L1 of the point where the putter surface P starts may be set to a value equal to or larger than a height L0 of the central portion of the golf ball B, as illustrated in FIG. 15A. Here, the heights are measured based on the ground on which the golf ball B and the variable face 120 are placed. In this case, the height L1 of the point where the putter surface P starts may be set in the range of about 22 to 23 mm, and the height of the point where the putter surface P ends may be set in the range of about 28 to 29 mm or set to a value equal to or larger than the range, for example. Actually, when a golfer makes a putting stroke using a putter, the putter is moved toward the golf ball B from the rear of the point where the golf ball B is placed, and the putter surface P of the putter is contacted with the rear of the golf ball B. In this case, the putter is moved along the trajectory where the putter is moved upward with the bottom surface thereof slightly separated from the ground. Therefore, even when the height of the start point of the putter surface P at the front of a putter head 410 is set to about 17 mm, the start point of the putter surface P at the moment that the putter surface P of the putter is contacted with the rear of the golf ball B is located at a level corresponding to the height (about 21.33 mm) of the center of the golf ball B or a slightly higher level than the height of the center of the golf ball B. Thus, during putting, the golf ball B may be naturally rolled and moved forward.

When the putter surface P of the variable face 120 of the putter in accordance with the embodiment of the present disclosure is a planar surface, the putter surface P may have a loft θ of 1° to 3° with respect to the vertical line as illustrated in the expanded view of FIG. 15A.

Furthermore, the height of the point where the putter surface P starts may be set to a value equal to the height L0 of the center of the golf ball B. Furthermore, when the putter surface P is a curved surface, the height L2 of the point where the putter surface P starts may be set to a smaller value than the height L0 of the center of the golf ball B as illustrated in the expanded view of FIG. 15B. In this case, the height L3 of the point where the putter surface P starts may be set in the range of about 17 to 18 mm, and the height of the point where the putter surface P ends may be set in the range of about 23 to 24 mm or set to a larger value than the range. Furthermore, the putter surface P may have a loft θ of about 1° to 3° with respect to the vertical line. Furthermore, as illustrated in FIG. 15C, the height L3 of the point where the putter surface P starts may be set to a value equal to or a larger than the height L0 of the center of the golf ball B.

When the golf club 100 and 100*b* in accordance with the embodiment of the present disclosure functions as the chipper, or when the variable face 120 of the golf club 100 and 100*b* functions as the chipper as illustrated in FIG. 15D, the height L4 of the point where the chipper surface C starts may be set to a smaller value than the height L0 of the center of the golf ball.

Referring to FIG. 16, a putting stroke will be described as follows. During putting, the putter surface P located at the top may hit the central portion of the golf ball B or the top or bottom of the golf ball B, adjacent to the central portion, and be then moved upward to roll and move the golf ball B forward. When the putter surface P is formed as a curved surface, the most protruding point of the putter surface P may first hit the central portion of the golf ball 100 or the top or bottom of the golf ball 100, adjacent to the central portion. When the variable face 120 of the golf club in accordance with the embodiment of the present disclosure is switched to the putter, the bottom of the putter surface P having the predetermined height L1, L2 or L3 may hit the central portion (height: L0) of the golf ball B or a portion right above or under the central portion. Thus, as illustrated in FIG. 16, the motion in which the putter surface P is moved upward while hitting the golf ball B during putting may roll and move the golf ball B forward. Such a motion may prevent a phenomenon in which the golf ball B is slipped and pushed forward by the putter, i.e. a skid effect. Thus, a rotational force may be more smoothly and correctly applied to the golf ball B. Therefore, the putter-chipper golf club in accordance with the embodiment of the present disclosure may improve the forward straightness and rotational force of the golf ball B, compared to the related art.

Figure 8A:
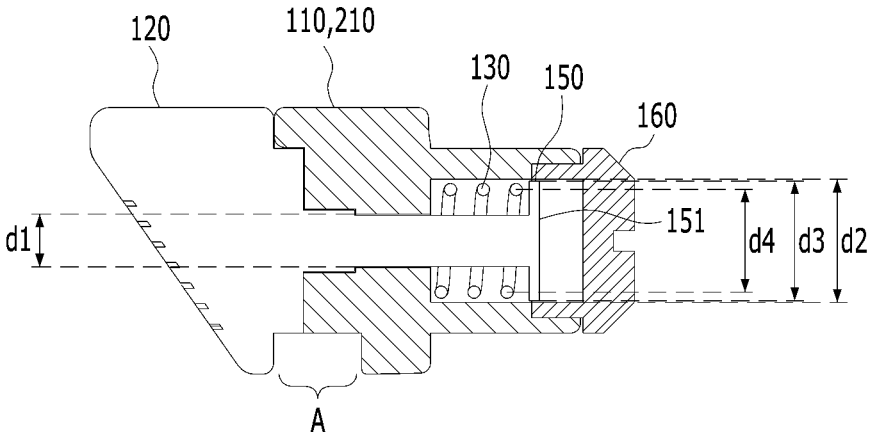
FIGS. 8A and 8B are cross-sectional views of the golf club in accordance with the embodiment of the present disclosure.

Furthermore, the putter-chipper golf club in accordance with the embodiment of the present disclosure may further include a washer 140 disposed between the spring 130 and the face cap 150. FIG. 8A is a cross-sectional view of the golf club without the washer 140, and FIG. 8B is a cross-sectional view of the golf club with the washer 140.

When the washer 140 is not disposed between the spring 130 and the face cap 150 as illustrated in FIG. 8A, the face cap 150 is axially moved to directly press the spring 130 in case that the variable face 120 is moved in the axial direction and separated from the body 110 while disengaged therefrom. Then, the spring 130 is compressed by the pressing. At this time, since the face cap 150 needs to be freely moved in the axial direction inside the large-diameter portion 116, the maximum diameter d3 of the head of the face cap 150 may be equal to or smaller than the inner diameter d2 of the large-diameter portion. Furthermore, since the face cap 150 needs to not only prevent a separation of the spring 130 but also stably support the spring 130, the maximum diameter d3 of the head of the face cap 150 may be larger than the average diameter d4 of the spring.

Figure 8B:
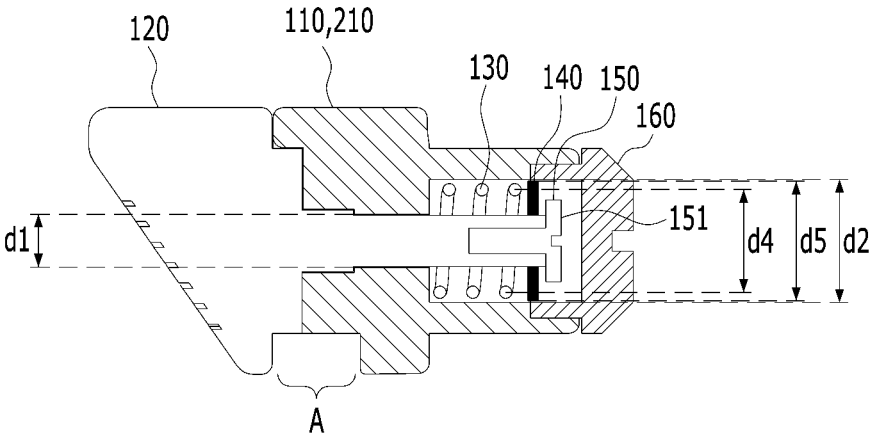

When the washer 140 is disposed between the spring 130 and the face cap 150 as illustrated in FIG. 8B, the face cap 150 is axially moved to press the washer 140 serving as a locking part, in case that the variable face 120 is axially moved and separated from the body 110. The washer 140 is also axially moved by the face cap 150, and presses the spring 130 while contacted with the spring 130, and the spring 130 is compressed by the pressing. At this time, since the washer 140 needs to be freely moved in the axial direction inside the large-diameter portion 116, the maximum diameter d5 of the washer 140 may be equal to or smaller than the inner diameter d2 of the large-diameter portion. Furthermore, since the washer 140 needs to not only prevent a separation of the spring 130 but also stably support the spring 130, the maximum diameter d5 of the washer 140 may be larger than the average diameter d4 of the spring.

The putter-chipper golf club 100 in accordance with the embodiment of the present disclosure may include one or more of the side weight 170 and the low weight 180, in order to adjust the center of gravity. The side weight 170 may be mounted on a side surface of the body 110, to which the variable face 120 is coupled. The low weight 180 may be mounted on the bottom surface of the body 110. The center of gravity may be distributed to the left and right bottoms by the side weight 170 and the low weight 180, which makes it possible to minimize an error range during putting or chipping. The side weight 170 and the low weight 180 may be configured to have various weights, and freely detached/attached according to a user's preference.

In the putter-chipper golf club 100 in accordance with the embodiment of the present disclosure, the variable face 120 may include an insert (not illustrated). The insert may include a plurality of rubbers or synthetic resins. Such a plurality of rubbers or synthetic resins may improve the frictional force of the golf head surface made of a metallic material, in order to more smoothly roll the golf ball B. Thus, the putter-chipper golf club may increase the forward rotational force of the golf ball B, thereby improving the straightness. Furthermore, the variable face 120 may include a plurality of small protrusions (not illustrated) formed on the putter surface P. For example, the plurality of small protrusions may be formed through a milling process. Such small protrusions may improve the frictional force with the golf ball B such that the golf ball B can be more smoothly rolled, which makes it possible to improve the straightness of the golf ball B.

Now, a coupling and decoupling process of the putter-chipper golf club 100 in accordance with the embodiment of the present disclosure will be described. FIG. 7A is a schematic cross-sectional view of the golf club when the body 110 and the variable face 120 are engaged with each other or the golf club functions as the putter; FIG. 7B is a schematic cross-sectional view of the golf club when the variable face 120 is separated from the body 110 such that the body 110 and the variable face 120 are disengaged from each other; and FIG. 7C is a cross-sectional view of the golf club when the variable face 120 is switched to the chipper.

As illustrated in FIG. 7A, the variable face 120 may be inserted and coupled into the through-hole formed in the body 110. Specifically, the coupling protrusion portion 120*a* of the variable face 120 and the coupling groove portion 110*a* of the body 110 may be engaged with each other while corresponding to each other. At this time, a part of the coupling shaft 123 of the coupling protrusion portion 120*a* may be inserted into the small-diameter portion 113 of the through-hole of the body, and another part of the coupling shaft 123 of the coupling protrusion portion 120*a* may be disposed in the large-diameter portion 116 of the through-hole. The spring 130 and the face cap 150 may be disposed in the large-diameter portion 116. At this time, the spring 130 may be disposed on the circumference of the coupling shaft 123 located in the large-diameter portion 116. Furthermore, the face cap 150 may be coupled to the end of the coupling shaft 123.

Then, as illustrated in FIG. 7B, the variable face 120 and the body 110 may be disengaged from each other. A user or the like may pull the variable face 120 through the space A, for example. As indicated by an arrow "a" in FIG. 7B, the variable face 120 may be partially separated from the body 110 while axially moved to one side (or front). At this time, the face cap 150 coupled to the end of the coupling shaft 123 may be axially moved to one side so as to press the spring 130 (or the washer 140 in case that the washer 140 is disposed between the spring 130 and the face cap 150). Then, the spring 130 may be compressed by the pressing. Then, as indicated by an arrow "c" in FIG. 7B, the positions of the chipper surface C and the putter surface P formed on one surface of the variable face 120 may be switched through the rotation of the variable face 120. For example, with the variable face 120 moved forward in the axial direction from the body 110, the variable face 120 may be rotated by about 180° to select the putter or the chipper. Then, as indicated by an arrow "b" in FIG. 7B, the switched variable face 120 may be moved toward the body 110 again in the axial direction. At this time, as the compressed spring is expanded again, the variable face 120 may be moved to the other side.

In accordance with the embodiment of the present disclosure, the engagement and the compression/expansion of the spring may switch the golf club to the golf club that functions as the chipper 100*b* as illustrated in FIG. 7C. That is, when the variable face 120 is pulled and rotated, the switch from the putter to the chipper may be performed by the expansion of the spring. The switch from the chipper 100*b* to the putter 100*a* is performed in the same manner as the above-described process.

Now, a putter-chipper golf club 200 in accordance with another embodiment of the present disclosure will be described. The putter-chipper golf club 200 in accordance with the present embodiment has the same configuration, function and coupling process as the golf club 100 in accordance with the above-described embodiment, except only the shape of a body 210 and the mounting structure of a side weight 220. Thus, the descriptions of the same components of the present embodiment as those of the above-described embodiment will be omitted herein.

Figure 9:
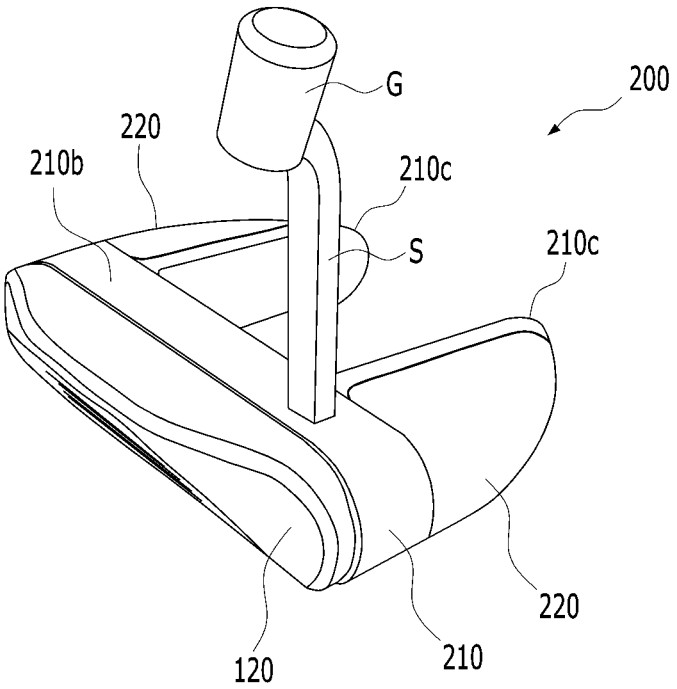
FIG. 9 is a schematic perspective view of a golf club in accordance with another embodiment of the present disclosure.
Figure 10A:
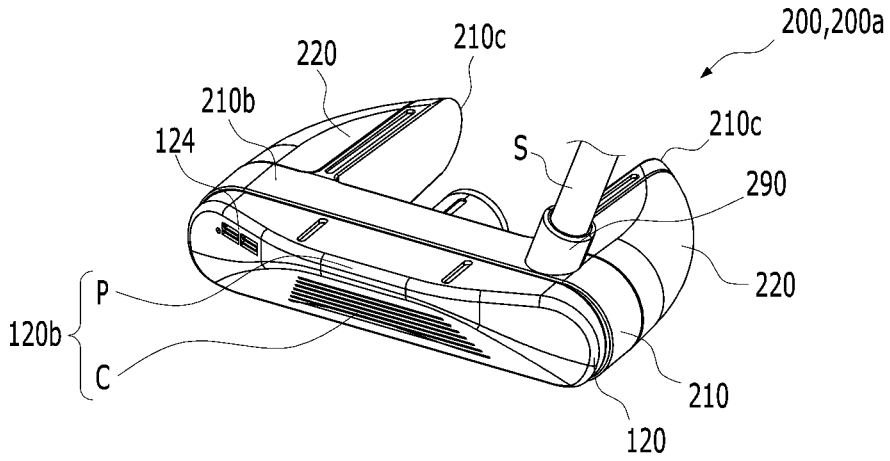
FIGS. 10A and 10B are expanded views of the golf club in accordance with the another embodiment of the present disclosure.
Figure 10B:
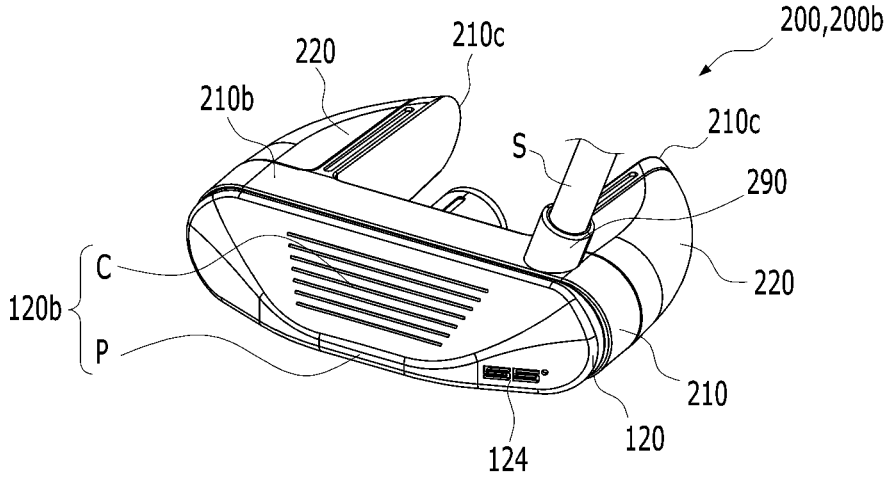
Figure 11:
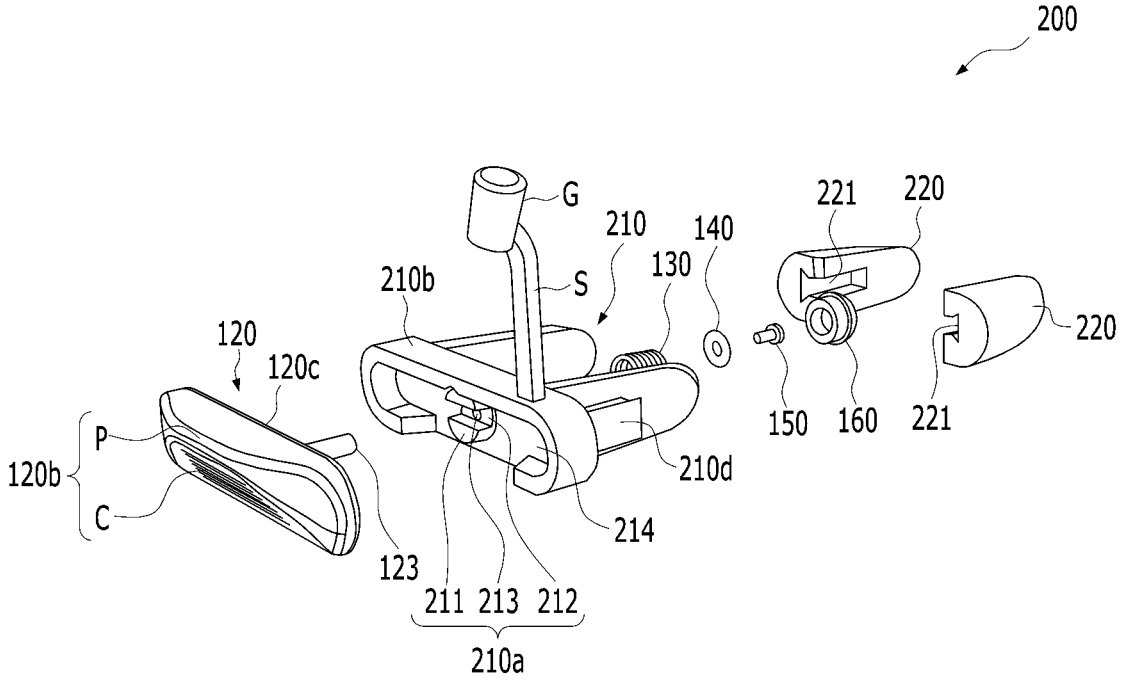
FIG. 11 is an exploded perspective view of the golf club in accordance with the another embodiment of the present disclosure.
Figure 12A:
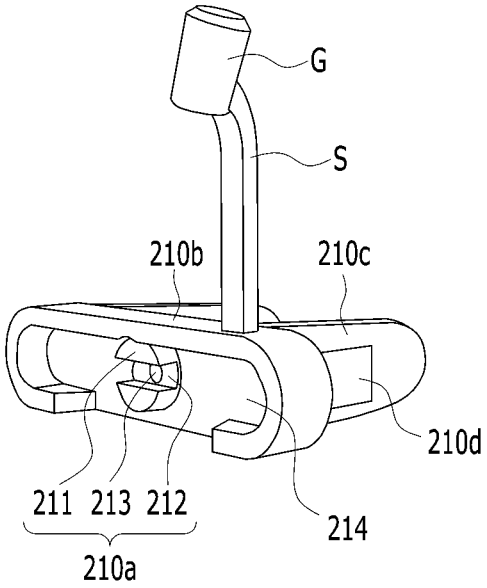
FIGS. 12A and 12B are perspective views illustrating a body of the golf club in accordance with the another embodiment of the present disclosure.
Figure 12B:
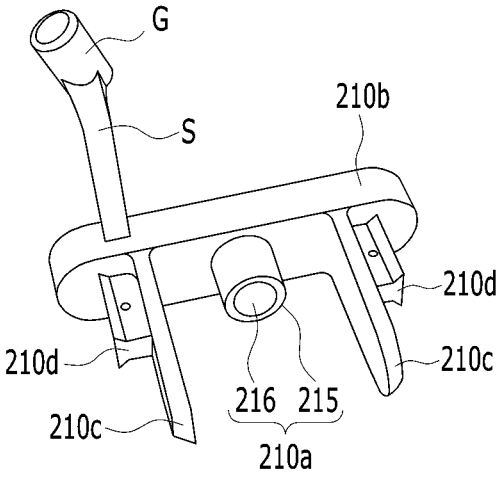
Figure 13A:
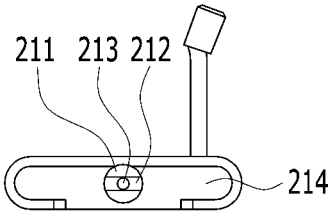
FIGS. 13A to 13E are schematic views illustrating the body of the golf club in accordance with the another embodiment of the present disclosure.
Figure 13B:
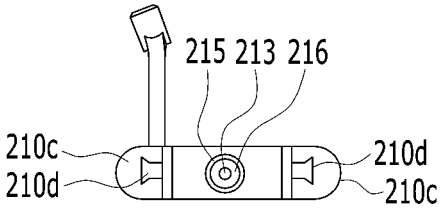
Figure 13C:
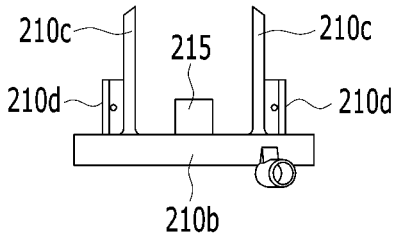
Figure 13D:
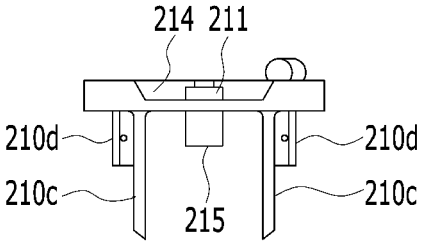
Figure 13E:
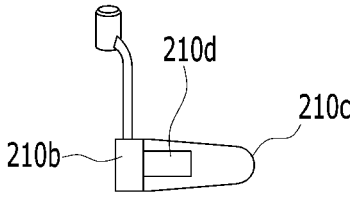

FIG. 9 is a perspective view of a putter-chipper golf club in accordance with another embodiment of the present disclosure, FIG. 10A is a diagram illustrating the golf club which functions as a putter 200*a*; FIG. 10B is a diagram illustrating the golf club which functions as a chipper 200*b*; FIG. 11 is an exploded perspective view of the putter-chipper golf club in accordance with the another embodiment of the present disclosure; FIG. 12A is a diagram illustrating a front surface of a body; FIG. 12B is a diagram illustrating a rear surface of the body; FIG. 13A is a schematic front view of the body; FIG. 13B is a schematic rear view of the body; FIG. 13C is a schematic plan view of the body; FIG. 13D is a schematic bottom view of the body; and FIG. 13E is a schematic side view of the body.

As illustrated in FIG. 11, the putter-chipper golf club 200 in accordance with the another embodiment of the present disclosure may include the body 210, a variable face 120, a spring 130, a face cap 150 and a pair of side weights 220. The center of gravity may be distributed through the side weights 220, which makes it possible to minimize an error range during putting or chipping.

Furthermore, the putter-chipper golf club 200 may further include a washer 140 or a body cap 160.

The body 210 of the putter-chipper golf club 200 may include a coupling groove portion 210*a*, a main body portion 210*b* and a tail portion 210*c* extended from the main body portion. Furthermore, the body 210 may have a concave portion 214 formed in a part of the front surface thereof. In order to adjust the center of gravity, another weight may be mounted on the concave portion 214. The coupling groove portion 210*a* may include a first corresponding portion 211, a second corresponding portion 212, a through-hole, a protrusion portion 215 and the like. The through-hole may have a small-diameter portion 213 and a large-diameter portion 216. The coupling groove portion 210*a* may be formed in a shape to be engaged with the variable face 120. For example, a first portion 121, a second portion 122 and a coupling shaft 123 of a coupling protrusion portion 120*a* of the variable face 120 may correspond to the first corresponding portion 211, the second corresponding portion 212 and the small-diameter portion 213 of the through-hole of the coupling groove portion 210*a*, respectively. However, the present disclosure is not limited thereto, but the coupling groove portion 210*a* may have various shapes.

In accordance with the present embodiment, as the position of the variable face 120 mounted on the body 210 is changed, the golf club 200 may function as the putter 200*a* or the chipper 200*b*. At this time, the variable face 120 may be rotated to change the position. For example, the golf club may function as the putter 200*a* when a putter surface P is located at the top (FIG. 10A), and function as the chipper 200*b* when a chipper surface C is located at the top (FIG. 10B).

In accordance with an embodiment of the present disclosure, as illustrated in FIG. 11, the body 210 may have a rail protrusion 210*d* formed on a coupling outer surface thereof, and the side weight 220 may have a rail groove 221 formed on a coupling inner surface thereof. For example, the rail protrusion 210*d* may be formed on the outer surface of the tail portion 210*c* of the body 210. Furthermore, the rail protrusion 210*d* of the body 210 and the rail groove 221 of the side weight 220 may be coupled to each other in a sliding manner or fitting manner, for example. However, the present disclosure is not limited thereto, and the rail protrusion 210*d* and the rail groove 221 may be coupled through various methods.

Now, a putter-chipper golf club in accordance with still another embodiment of the present disclosure will be described. The golf club in accordance with the present embodiment may include a body 110 having a shaft S connected thereto and a variable face 120 coupled to one side of the body 110. The variable face 120 may have one surface formed as a putter surface P and a chipper surface C. Specifically, a part of the one surface, corresponding to a height h1, may be formed as the putter surface P, and the other part of the one surface, corresponding to a height h2 different from the height h1, may be formed as the chipper surface C. As described above, both the putter surface P and the chipper surface C may be formed on one surface of the variable face 120, for example, the front surface of the variable face 120. Thus, the golf club may be switched to the putter or chipper through a simple manipulation (e.g. rotation). Furthermore, during putting, the putter surface P may be moved upward while hitting a golf ball B, and thus roll and move the golf ball B forward. Such a motion may prevent a phenomenon in which the golf ball B is slipped and pushed forward by the putter, i.e. a skid effect. Thus, a rotational force may be more smoothly and correctly applied to the golf ball B.

Now, a putter-chipper golf club in accordance with yet another embodiment of the present disclosure will be described with reference to FIGS. 17A to 17D.

The putter-chipper golf club in accordance with the yet another embodiment of the present disclosure may include a body 310 having a shaft S connected thereto; and a variable face 320 coupled to one side of the body 310. The variable face 320 has one surface formed as a putter surface P and a chipper surface C. Specifically, a part of the one surface, corresponding to a height h1, may be formed as the putter surface P, and the other part of the one surface, corresponding to a height h2 different from the height h1, may be formed as the chipper surface C.

Figure 17A:
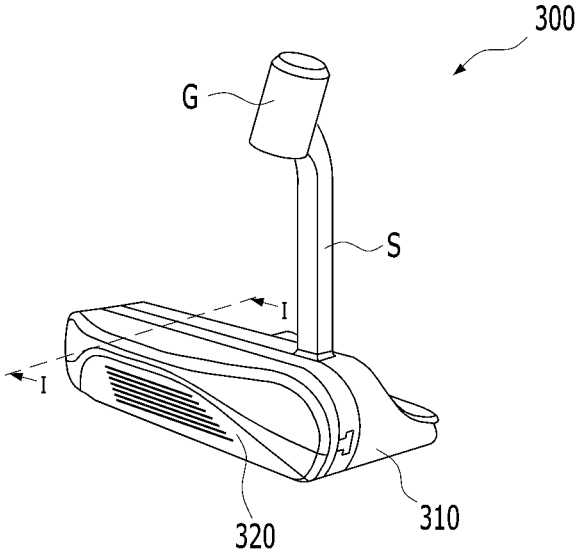
FIGS. 17A to 17D are schematic views illustrating a golf club with a variable face in accordance with yet another embodiments of the present disclosure.
Figure 17B:
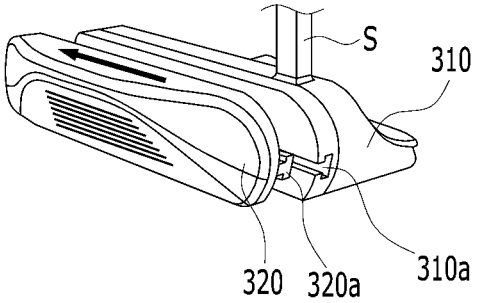
Figure 17C:
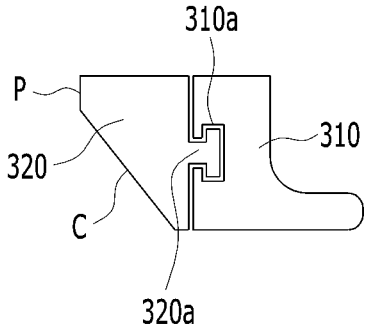
Figure 17D:
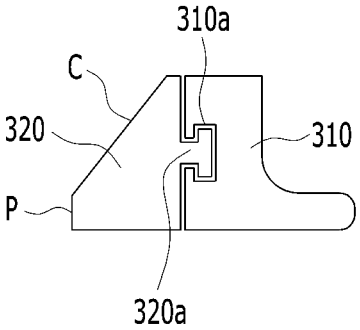

FIGS. 17A and 17B illustrate that the variable face 320 and the body 310 of the putter-chipper golf club in accordance with the present embodiment are coupled in a sliding manner, and FIGS. 17C and 17D are cross-sectional views taken along line I-I of FIG. 17A. As illustrated in FIGS. 17A and 17B, the putter-chipper golf club in accordance with the present embodiment may function as the putter or chipper through a process of changing the position where the variable face 320 is mounted on the body 310, through a sliding coupling manner. When the variable face 320 and the body 310 are coupled to each other in a sliding manner as illustrated in FIG. 17B, a rail protrusion 320*a* may be formed on a coupling surface of the variable face 320 or a coupling surface of the body 310, a rail groove 310*a* corresponding to the contour of the rail protrusion may be formed on the coupling surface of the variable face 320 or the coupling face of the body 310, and the rail protrusion 320*a* and the rail groove 310*a* may be engaged and coupled with each other in a sliding manner. When the variable face 320 and the body 310 are engaged and coupled with each other by sliding, the coupling state therebetween may be reliably maintained by a stopper (not illustrated). As such, the configuration in which the variable face 320 and the body 310 are engaged with each other in a sliding manner may simplify the structure of the putter-chipper golf club in accordance with the embodiment of the present disclosure.

In the putter-chipper golf club in accordance with the embodiment of the present disclosure, the variable face and the body may be coupled to each other in a fitting manner.

When the putter-chipper golf club illustrated in FIGS. 17A to 17D is used as the putter, the variable face 320 may be slid and engaged with the body 310 such that the putter surface P is disposed at the top and the chipper surface C is disposed at the bottom, as illustrated in FIG. 17C. In this case, the height of the point where the putter surface P starts may be set in the range of about 17 mm to about 23 mm. Then, the height of the point where the putter surface P starts may be set in the range of a height slightly lower than the height (about 21.33 mm) of the center of a golf ball B to a height slightly higher than the height of the center of the golf ball B.

When the putter-chipper golf club illustrated in FIGS. 17A to 17D is used as the chipper, the variable face 320 may be slid and engaged with the body 310 such that the chipper surface C is disposed at the top and the putter surface P is disposed at the bottom, as illustrated in FIG. 17D. In this case, the height of the point where the chipper surface C starts is set to a smaller value than the height of the center of the golf ball B.

In accordance with still yet another embodiment, a body and a variable face may be coupled to each other through a magnet or rotation, for example. However, these methods are only examples, and the body and the variable face may be coupled through various methods.

Now, a golf club in accordance with still yet another embodiment of the present disclosure will be described with reference to FIGS. 18 and 19A to 19C.

Figure 18:
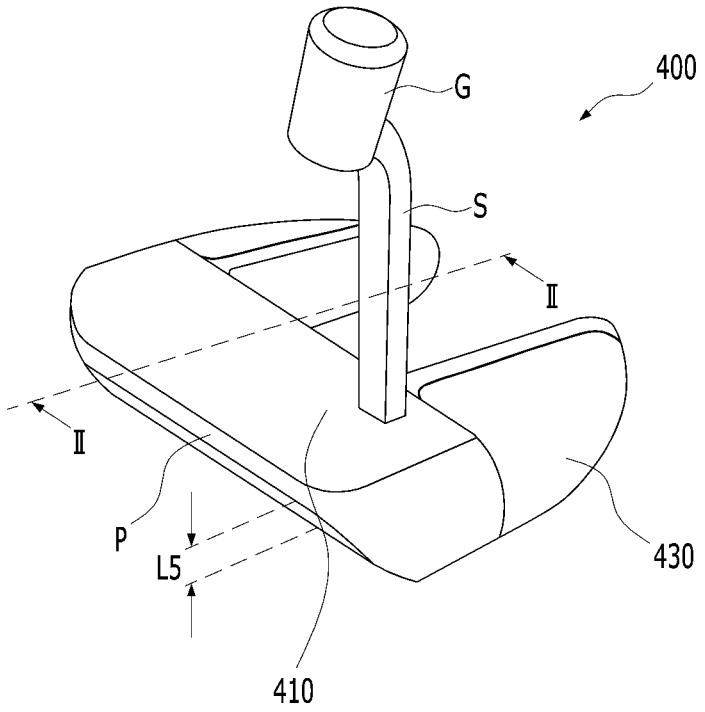
FIG. 18 is a schematic view illustrating a putter head for a golf putter in accordance with still yet another embodiment of the present disclosure.

In accordance with the still yet another embodiment illustrated in FIG. 18, the golf club has a putter head configured in such a manner that only a front top region of the putter head functions as a putter surface.

Specifically, in the putter head 410 for a golf putter, to which a shaft S having a grip G hold by a user's hand is coupled, only a front top region thereof may function as a putter surface P, and a front bottom region thereof may be formed as a space which is not contacted with a golf ball B. In this case, as illustrated in FIGS. 18 and 19A to 19C, the height L5 of the start point of the putter surface P at the front of the putter head 410 may be set in the range of about 17 mm to about 23 mm. Then, the height of the point where the putter surface P starts may be set in the range of a height slightly lower the height (about 21.33 mm) of the center of the golf ball B to a height slightly higher than the height of the center of the golf ball B. Actually, when the putter is moved toward the golf ball B from the rear of the point where the golf ball B is placed, and the putter surface P of the putter is contacted with the rear of the golf ball B while a golfer makes a putt using the putter, the bottom surface of the putter through which the user strokes the golf ball B may be moved along the ground or moved while slightly spaced apart from the ground, and then moved upward from around the contact point with the golf ball B. Therefore, even when the height of the start point of the putter surface P at the front of the putter head 410 is set to about 17 mm, the start point of the putter surface P at the moment that the putter surface P of the putter is contacted with the rear of the golf ball B is located at the height (about 21.33 mm) of the center of the golf ball B or slightly above the height of the center of the golf ball B. Thus, during putting, the golf ball B may be naturally rolled and moved forward.

Therefore, when the height L5 of the start point of the putter surface P at the front of the putter head 410 is set in the range of about 17 mm to about 23 mm, the golf ball B may be rolled and moved forward through the motion of the putter surface P which is moved upward after hitting the golf ball B during putting, as illustrated in FIG. 16. Such a motion may prevent a phenomenon in which the golf ball B is slipped and pushed forward by the putter, i.e. a skid effect. Thus, a rotational force may be more smoothly and correctly applied to the golf ball B.

Figure 19A:
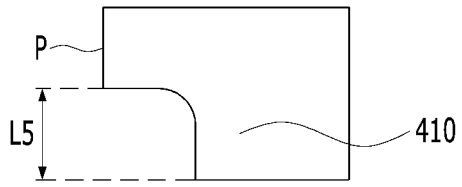
FIG. 19A to 19C are schematic cross-sectional views of the putter head of FIG. 18, taken along line II-II.
Figure 19B:
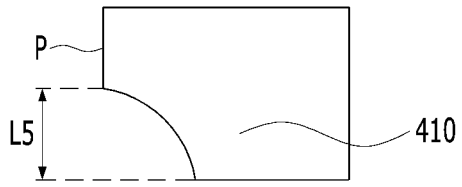
Figure 19C:
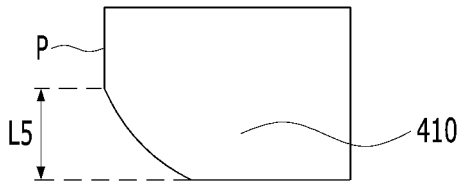

In the putter head in accordance with the embodiment illustrated in FIG. 18, the front bottom region of the putter is formed as the space which is not contacted with the golf ball B, such that the putter surface P can hit a portion of the golf ball B, corresponding to a higher level than the height of the center of the golf ball B, during putting. For example, as illustrated in FIG. 19A which is a cross-sectional view taken along line II-II of FIG. 18, the upper portion of the putter head 410 may protrude forward to form the putter surface P, and the space may be formed at the bottom of the putter surface P. Furthermore, as illustrated in FIG. 19B, a space having a concave circular arc contour may be formed at the bottom of the putter surface P. Furthermore, as illustrated in FIG. 19C, a space having a convex circular arc contour may be formed at the bottom of the putter surface P.

In the putter head in accordance with the embodiment illustrated in FIG. 18, the putter surface P may be formed as a planar surface or convex curved surface. When the putter surface P is formed as a planar surface, the putter surface P may have a loft θ of about 1° to 3° with respect to the vertical line.

While various embodiments have been described above, it will be understood to those skilled in the art that the embodiments described are by way of example only.

Accordingly, the disclosure described herein should not be limited based on the described embodiments.

The invention claimed is:

1. A putter-chipper golf club comprising:

a body 110 having a shaft S connected thereto, and including a coupling groove portion 110*a* having a through-hole formed therein;

a variable face 120 disposed on one side of the body 110, including a coupling protrusion portion 120*a* which is inserted into the through-hole and engaged with the coupling groove portion 110*a*, and configured to function as a putter face or a chipper face;

a spring 130 stored in the through-hole of the coupling groove portion 110*a*, and disposed on the circumference of a part of the coupling protrusion portion 120*a*; and a face cap 150 disposed adjacent to the spring 130, and coupled to an end of the coupling protrusion portion 120*a* of the variable face 120, wherein when the coupling groove portion 110*a* of the body 110 and the coupling protrusion portion 120*a* of the variable face 120 are disengaged from each other by pulling the variable face 120 from the body 110 toward one side, the golf club is switched to a putter or a chipper through rotation of the variable face 120.

2. The putter-chipper golf club of claim 1, wherein a part of the front surface of the variable face 120, corresponding to a height h1, is formed as a putter surface P, and the other part of the front surface of the variable face 120, corresponding to a height h2 different from the height h1, is formed as a chipper surface C.

3. The putter-chipper golf club of claim 1, wherein the through-hole of the body 110 is constituted by a small-diameter portion and a large-diameter portion, and the coupling protrusion portion 120*a* of the variable face 120 is inserted into the small-diameter portion of the through-hole of the body 110, wherein the spring 130 is stored in the large-diameter portion of the through-hole of the body 110.

4. The putter-chipper golf club of claim 1, wherein the golf club functions as a putter when the putter surface P is located at the top, and functions as a chipper when the chipper surface C is located at the top.

5. The putter-chipper golf club of claim 4, wherein when the golf club functions as a putter and the putter surface P is a planar surface, the height of the point where the putter surface P starts is set in the range of about 17 mm to 23 mm.

6. The putter-chipper golf club of claim 4, wherein when the golf club functions as a putter and the putter surface P is a curved surface, a height L2 of the most protruding portion of the putter surface P toward the front is set to a value equal to or higher than a height L0 of the center of a golf ball B.

7. The putter-chipper golf club of claim 4, wherein when the golf club functions as a chipper, the angle between the chipper surface C and the ground ranges from about 35° to 65°.

8. The putter-chipper golf club of claim 1, wherein the putter surface P is formed as a planar surface or a curved surface.

9. The putter-chipper golf club of claim 8, wherein when the putter surface P is a planar surface, the putter surface P has a loft θ of 1° to 3° with respect to a vertical line.

10. The putter-chipper golf club of claim 1, wherein the inside contour of the coupling groove portion 110*a* of the body 110 and the outside contour of the coupling protrusion portion 120*a* of the variable face 120 correspond to each other, wherein when the variable face 120 is axially moved toward the body 110, the inside contour of the coupling groove portion 110*a* of the body 110 and the outside contour of the coupling protrusion portion 120*a* of the variable face 120 are fitted and engaged with each other.

11. A putter-chipper golf club comprising:

a body 310 having a shaft S connected thereto; and a variable face 320 coupled to one side of the body 310, wherein the variable face 320 has a putter surface P corresponding to a height h1 and a chipper surface C corresponding to a height h2 different from the height h1, the variable face 320 and the body 310 are coupled to each other by fitting or sliding, and the position where the variable face 320 is mounted on the body 310 is changed so that the golf club functions as a putter or a chipper.

12. The putter-chipper golf club of claim 11, wherein when the variable face 320 and the body 310 are coupled to each other by sliding, a rail protrusion is formed on a coupling surface of the variable face 320 or a coupling surface of the body 310, a rail groove corresponding to the contour of the rail protrusion is formed on the coupling surface of the variable face 320 or the coupling surface of the body 310, and the rail protrusion and the rail groove are engaged and coupled with each other by sliding.

13. A putter head, to which a shaft S having a grip held by a user's hand is coupled, wherein only a front top region of the putter head 410 functions as a putter surface P, and a front bottom region of the putter head 410 is formed as a space which is not contacted with a golf ball B, wherein a height L5 of the start point of the putter surface P at the front of the putter head 400 is set in the range of about 17 mm to about 23 mm.

* * * * *